US008613690B1

(12) United States Patent
Thompson

(10) Patent No.: US 8,613,690 B1
(45) Date of Patent: Dec. 24, 2013

(54) NECK THERAPY DEVICE

(76) Inventor: Monty R. Thompson, Aspen, CO (US)

( * ) Notice: Subject to any disclaimer, the term of this patent is extended or adjusted under 35 U.S.C. 154(b) by 431 days.

(21) Appl. No.: 12/985,306

(22) Filed: Jan. 5, 2011

Related U.S. Application Data

(60) Provisional application No. 61/322,716, filed on Apr. 9, 2010.

(51) Int. Cl.
*A63B 23/025* (2006.01)
*A63B 21/02* (2006.01)

(52) U.S. Cl.
USPC ..... 482/10; 482/124

(58) Field of Classification Search
USPC ..... 482/10, 124, 130; 602/36; 601/1, 23, 601/25, 39
See application file for complete search history.

(56) References Cited

U.S. PATENT DOCUMENTS 2,633,124 A * 3/1953 Yellin ..... 602/36
4,111,415 A * 9/1978 Reitano ..... 482/10
4,327,909 A * 5/1982 Neufeld ..... 482/124
4,456,249 A * 6/1984 Calabrese ..... 482/124
4,537,393 A * 8/1985 Kusch ..... 482/10
4,645,198 A * 2/1987 Levenston ..... 482/10
4,789,154 A * 12/1988 Mattox ..... 482/10
4,832,333 A * 5/1989 Lockett ..... 482/10
5,162,027 A * 11/1992 Robinson ..... 482/10
5,242,347 A * 9/1993 Keeton ..... 482/102
5,295,949 A * 3/1994 Hathaway ..... 602/18
5,372,565 A * 12/1994 Burdenko ..... 482/124
5,498,218 A * 3/1996 Proctor et al. ..... 482/10
5,505,677 A * 4/1996 Hinds ..... 482/10
5,509,869 A * 4/1996 Miller ..... 482/10
5,662,554 A * 9/1997 Schaefer ..... 482/10
5,681,248 A * 10/1997 Vani ..... 482/126
5,813,954 A * 9/1998 Wilkinson ..... 482/124
5,971,890 A * 10/1999 Tyne ..... 482/10
6,007,463 A * 12/1999 Wells et al. ..... 482/126
D438,577 S * 3/2001 Phillips ..... D21/662
6,921,357 B2 * 7/2005 Basting ..... 482/121
6,939,269 B2 * 9/2005 Makofsky ..... 482/10
7,104,926 B2 * 9/2006 Carlson ..... 482/10
7,238,144 B2 * 7/2007 Ferrara ..... 482/11
7,322,908 B2 * 1/2008 DiGiacomo ..... 482/121
7,390,286 B1 * 6/2008 Edgeton ..... 482/10
7,998,099 B2 * 8/2011 Tull et al. ..... 602/17
2004/0058780 A1 * 3/2004 Edgeton ..... 482/10
2005/0043154 A1 * 2/2005 Atrizadeh ..... 482/124
2007/0032355 A1 2/2007 DiGiacomo
2008/0119331 A1 5/2008 Zylstra
2010/0041528 A1 * 2/2010 Todd ..... 482/124

* cited by examiner

*Primary Examiner* — Stephen Crow
(74) *Attorney, Agent, or Firm* — Leyendecker & Lemire, LLC

(57) ABSTRACT

A neck therapy device adapted to exercise a user's neck is described. The neck therapy device includes a headpiece on which resides a plurality of loops, and through which a strap extends. The strap is typically elastic. The headpiece includes a band portion adapted to encircle a user's head like a headband, extending across the user's forehead and back of head. A user typically grasps ends of the strap in order to modulate neck movement.

13 Claims, 16 Drawing Sheets

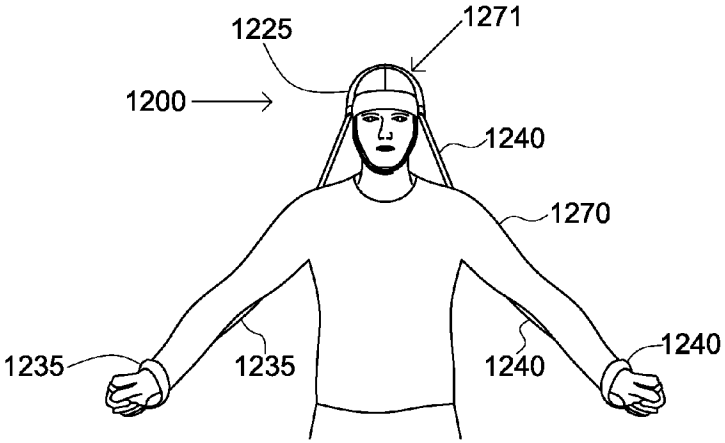
FIG. 12A
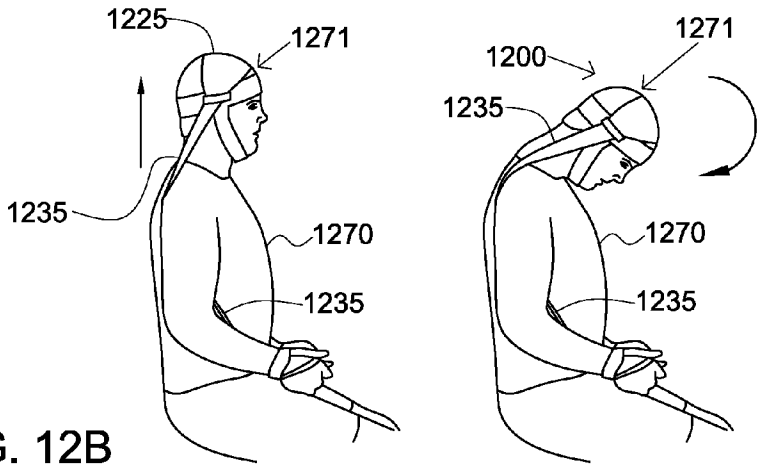
FIG. 12B
FIG. 12C

NECK THERAPY DEVICE

This application claims priority to and incorporates by reference U.S. provisional Patent Application No. 61/322,716, filed 9 Apr. 2010, having the same inventor and title as the present application.

FIELD OF THE INVENTION

The present invention relates generally to devices for stretching and exercising a user's neck.

BACKGROUND

Stretching and exercising a person's neck presents numerous challenges. One problem is that applying force or resistance to a person's neck usually involves directly coupling a device to the person's head, and such devices are typically complicated, uncomfortable, unwieldy, or ineffective. In addition, lifting weights or weight stacks via pulleys, flexed bands, or cables, leaves the user unable to modulate resistance while lifting. The user thus risks injury if he or she finds, while performing an exercise, that the resistance is too great.

Another problem is that a human neck is capable of multiple ways of moving, including flexion (bending forward, chin down), extension (bending backward, chin up), tilting (tilting the head side to side), and rotation (turning the head left or right, as in shaking one's head "no"), and combinations thereof. A person can also longitudinally extend his or her neck, by "standing tall." Thus a device must be adapted to apply force or resistance in many different directions in order to exercise many different neck motions. For instance, a user may wish to apply force relatively straight downwardly while the user strives to extend his or her neck vertically, relatively straight up. A user may also wish to apply force downwardly at about a 45° angle to vertical, in order to affect tilting, forward flexion, backward extension, or combinations thereof. A user may also wish to apply rotational force or resistance such that rotation of a person's head is assisted or resisted.

Head movement is typically assisted when a resistance band is pulling in substantially the same direction as the head movement. An assisted movement can be associated with eccentric contraction of muscles. Head movement is typically resisted when a resistance band is pulling against the direction of head movement. A resisted movement can be associated with concentric contraction. In some embodiments, the resistance band applies force for an isometric contraction in which the load applied by the resistance band is matched by an opposite force due to muscular contraction, and no appreciable head movement results.

BRIEF DESCRIPTION OF THE DRAWINGS

FIGS. 12A-12C illustrate a method of use of a neck therapy device according to one embodiment of the present invention.

DETAILED DESCRIPTION

Figure 1:
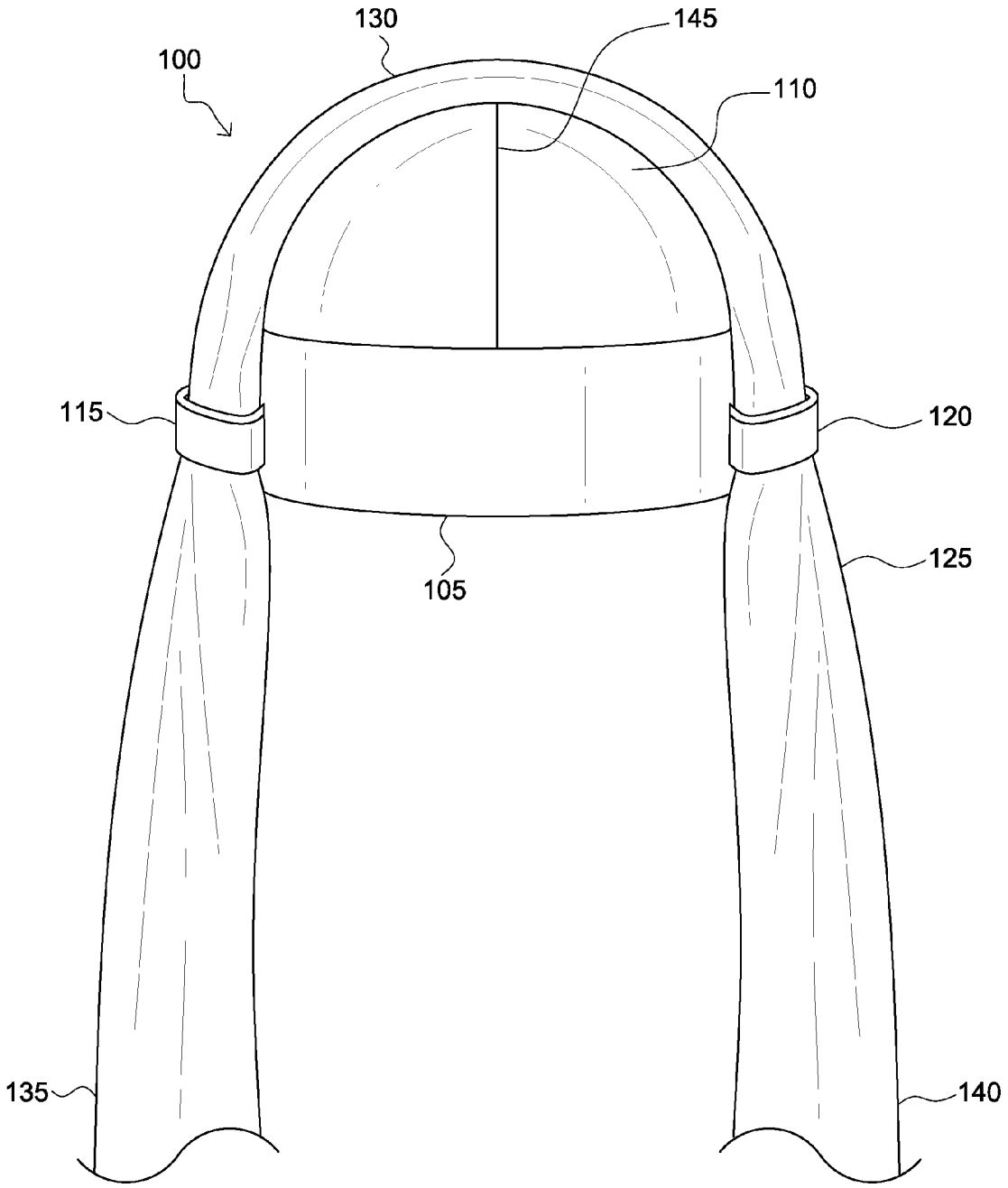
FIG. 1 is a front view of a neck therapy device according to one embodiment of the present invention.

Embodiments of the present invention comprise a neck therapy device adapted to exercise a user's neck. Exercises performed with the neck therapy device typically engage muscles or connective tissue in the user's neck. Thus the neck therapy device can be used to strengthen or stretch the muscles and associated connective tissue. A user's upper back, shoulders, arms, and core may also be engaged, and thus strengthened or stretched. Accordingly, the neck therapy device is adapted to perform neck exercises that strengthen or increase range of motion in the user's neck.

Circumstances where a user can benefit from use of the neck therapy device include (i) neck exercises for rehabilitation from injury, including pre-surgical or post-surgical rehabilitation, (ii) neck exercises for injury prevention or to increase athletic performance, and (iii) neck exercises for improving posture and mobility.

The neck therapy device comprises a headpiece on which is disposed one or more strap loops through which a resistance strap extends. The resistance strap is typically, but not necessarily, elastic. The headpiece includes a band portion adapted to encircle a user's head like a headband, extending across the user's forehead, sides of head, and back of head. In some embodiments the band portion is adjustable. The adjustable band portion enables the headpiece to have a snug fit on different sized heads.

Strap loops are typically attached directly to the band portion. In typical use, the band portion encircles a head of a user as described above, and two strap loops are attached directly to the band portion, one strap loop proximate each temple of the user. The resistance strap passes through the two strap loops and passes across a top of the user's head between the two strap loops. The resistance strap typically extends about 2.5 feet below each strap loop. The user typically grasps the resistance strap with both of the user's hands, and pulls on the resistance strap to apply force to the head of the user. The force is transmitted to the neck, where the force may be resisted by the user, or the user may submit to the force. Thus the force may work or stretch neck muscles or connective tissue.

In some embodiments, the headpiece has a cap portion, the cap portion being coupled to the band portion and comprising an approximately hemispherical concavity adapted to receive the top of the head of the user.

Embodiments of the neck therapy device are lightweight and can be folded or crumpled into a relatively compact orientation, which makes them easy to stow and transport. Moreover, the neck therapy device can be used in various positions, including sitting, standing, kneeling, and prone positions. The neck therapy device is well adapted for use by wheelchair bound persons, where its portability and ease of use in a sitting position are advantageous. The resistance strap can be secured to the wheelchair itself to provide resistance for neck exercises, which can be advantageous for wheelchair bound users without full use of arms or hands,

TERMINOLOGY

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

The term "supple," as used in this specification and appended claims, refers to flexible or pliant material that folds and crumples with little resistance and without breaking or deforming permanently.

The term "wearing," as used in this specification and appended claims, refers to placing neck therapy device on a user's head with a band portion of the neck therapy device encircling the user's head.

The term "neck," as used in this specification and appended claims, refers to the cervical vertebrae (the top 7 vertebrae, also referred to as the cervical spine) and associated soft tissue of a human. The soft tissue includes muscles, cartilage, ligaments, and other connective tissue related to movement, support, or stabilization of the cervical vertebrae and the human's head. The neck is capable of multiple ways of moving, including: (i) flexion, wherein the head moves forwardly as the neck curves about a generally horizontal axis and the chin moves toward the chest (as in a forward nod); (ii) extension (also referred to as backward extension), wherein the head moves backwardly as the neck curves about a generally horizontal axis and the chin moves away from the chest (as in looking up); (iii) tilting, wherein the head tilts or leans to one side or the other as the neck curves about a generally horizontal axis; and (iv) rotation, where the head rotates about a generally vertical axis as the head turns side to side (as shaking one's head to say "no"), the cervical vertebrae residing about along the generally vertical axis of rotation of the head. These multiple ways of moving can be combined in ways such as, but not limited to, where a person flexes his or her neck partially forward and partially tilts his or her head to a side at the same time. The multiple ways of moving also include "longitudinally extending" one's neck, wherein a person "stands tall." Standing tall involves the person straightening his or her spine, including the cervical spine, which results in the spine being functionally or practically longer than when less straight.

Standing tall/longitudinally extending one's neck can result in the appearance or sensation of increasing intra-vertebral distance or space. Although standing tall/longitudinally extending ones neck is generally performed with a person sitting or standing, and the cervical spine therefore oriented about vertically, it can be performed in a prone position. Performing a neck exercise comprises a user engaging in one or more of the multiple ways of moving described above, i.e. flexion, extension, tilting, rotation, and longitudinal extension, while wearing a neck therapy device. Neck exercise can also include isometric activity whereby a user engages muscles and connective tissue as if to perform one or more of the multiple ways of moving described above, but the movement is prevented or restricted by resistance provided by use of the neck therapy device.

The terms "extend," "extension," "extend backwardly" or "backward extension," as used in this specification and appended claims, distinguishes a neck movement wherein the head moves backwardly as the neck curves about a generally horizontal axis and the chin moves away from the chest (as in looking up) from "longitudinal extension," wherein a person straightens his or her cervical spine, as in "standing tall," as described above.

The term "grasping," as used in this specification and appended claims, refers to gripping an object in a user's hand or hands.

The term "concavity," as used in this specification and appended claims, refers to a depression, cavity, or hollow having a boundary that is curved like an inside surface of a hollow sphere or hemisphere.

The term "elastic," as used in this specification and appended claims, refers to a structure adapted to stretch by at least 10%, and to return to its unstretched condition substantially undamaged by the stretching. Accordingly, a strap that is elastic and is 5 feet long in an unstretched condition, would be capable of stretching to at least 5.5 feet.

A First Embodiment Neck Therapy Device

Figure 2:
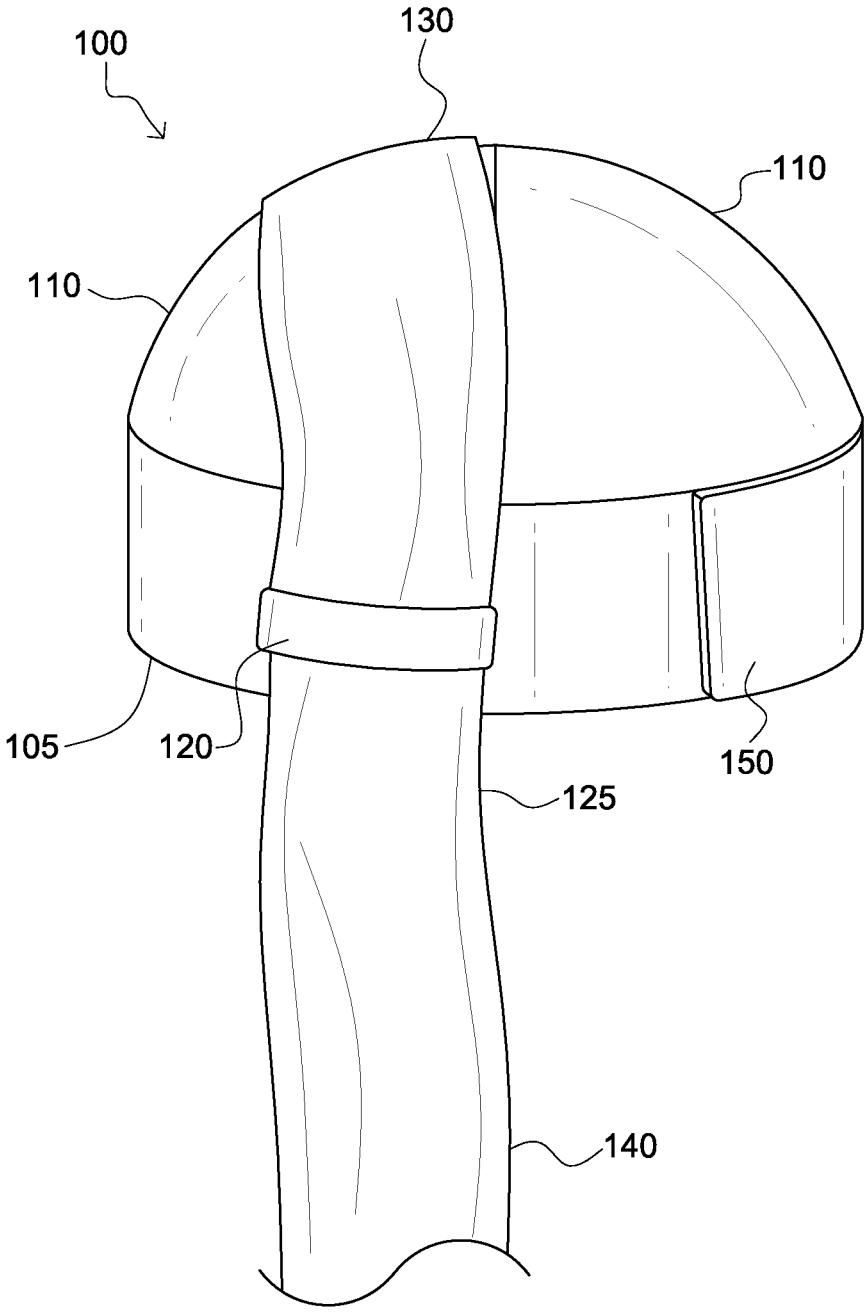
FIG. 2 is a side view of a neck therapy device according to one embodiment of the present invention.
Figure 3:
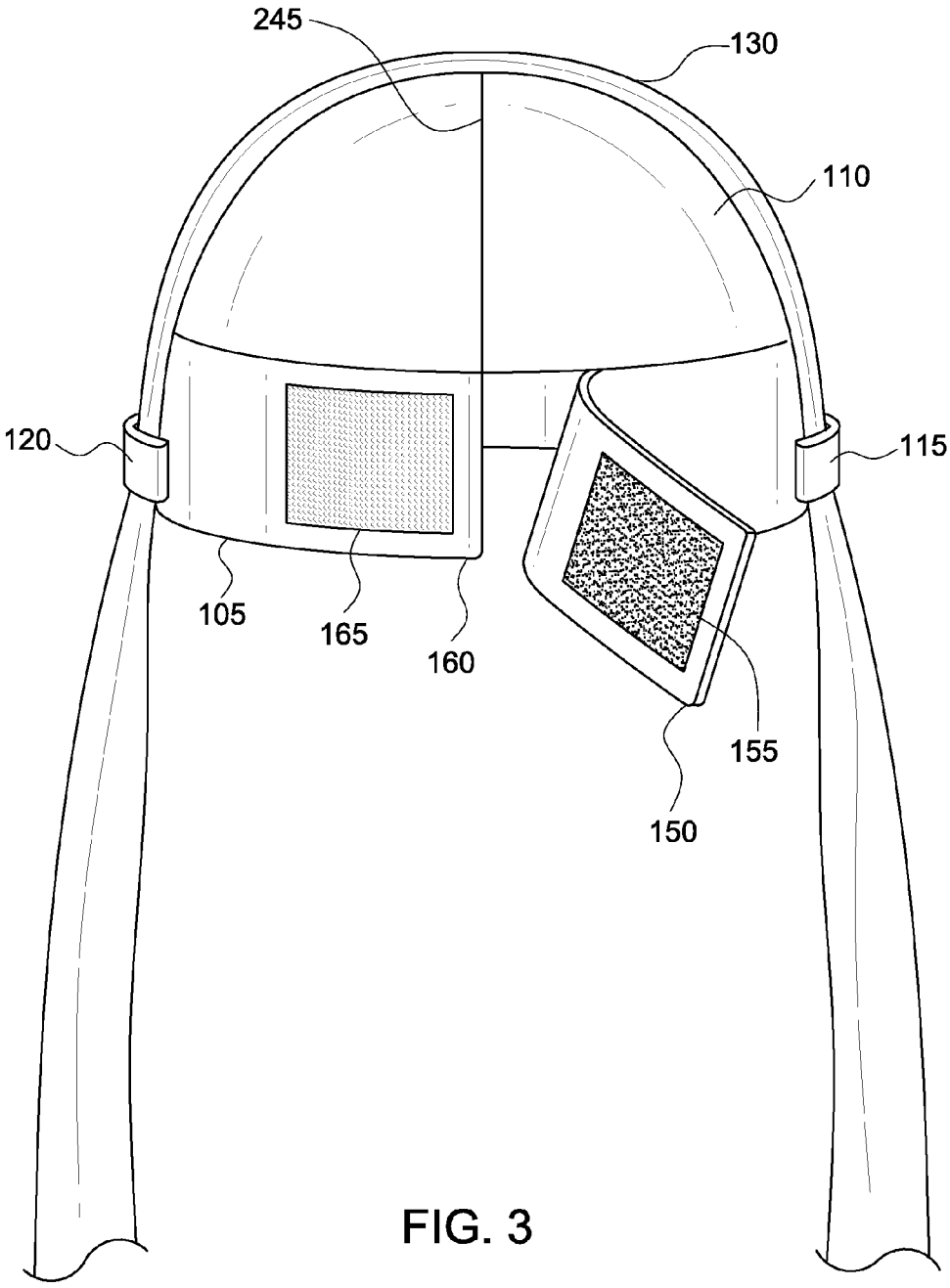
FIG. 3 is a back view of a neck therapy device according to one embodiment of the present invention.

A first embodiment neck therapy device 100 is illustrated in FIGS. 1-4. Front, side, and back views are illustrated in FIGS. 1, 2, and 3, respectively. The first embodiment neck therapy device comprises a headpiece, the headpiece including a band portion 105 and a cap portion 110. The band portion comprises supple material and forms a closed loop adapted to encircle a user's head like a headband, extending across the user's forehead and back of head. The closed loop of the band portion has a circumference of preferably more than 15 inches, more preferably 18 inches to 26 inches, and most preferably 20.5 to 24 inches. The cap portion comprises a cap concavity adapted to receive a top portion of a user's head. The cap concavity is approximately hemispherical and has a volume preferably greater than 21 cubic inches, more preferably between 41 and 115 cubic inches, and most preferably between 58 and 93 cubic inches. The cap portion of the first embodiment further comprises supple material.

A first strap loop 115 and a second strap loop 120 are disposed on the band portion 105, and a resistance strap 125 passes through each of the first and second strap loops. A middle section 130 of the resistance strap 125 passes over the cap portion 110 between the first and second strap loops. The first and second strap loops of the first embodiment neck therapy device are sewn onto the band portion 105 of the headpiece. A first end section 135 of the resistance strap hangs below the first strap loop 115 and a second end section 140 of the resistance strap hangs below the second strap loop 120.

In some embodiments, strap loops are integral with the headpiece. For instance, some embodiments comprise a strap loop that includes two horizontal slots that reside in the band portion disposed one above the other, with a strip of band portion material residing between the two horizontal slots. So configured, a resistance strap passes through the two slots, passing behind the strip of band portion material.

The resistance strap 125 of the first embodiment is elastic. Elasticity parameters of the resistance strap 125 include that it is capable of stretching preferably at least 10%, more preferably at least 25%, still more preferably at least 50%, and most preferably at least 100%. Elasticity parameters also include resistance to stretching.

The first embodiment resistance strap is an elastic strap about 5.5 inches in width and about 6 feet in length. Other embodiments include other resistance straps, including, but not limited to, Thera-Band® exercise bands. Some resistance straps are not Thera-Band® exercise bands. Variations include resistance straps comprising elastomeric compositions. Some embodiments of the resistance straps comprise lines, ropes, or cords. Embodiments of resistance straps are preferably at least 2 feet long, more preferably between 2 feet and 10 feet long, and most preferably between 4.5 feet and 7.5 feet long. In the first embodiment neck therapy device, the resistance strap is elastic and includes an elastic safety cord embedded in the resistance strap (not visible).

In some embodiments, the safety cord is integrated into or embedded in a Thera-Band® exercise band. For instance, in an embodiment the resistance strap includes a Thera-Band® exercise band with a 15 mm flap of the exercise band folded along an entire longitudinal edge, and sealed to create a hem. A 2 mm elastic cord is contained within the hem/folded flap along an entire length of the exercise band, the 2 mm elastic cord being a safety cord that prevents the exercise band from rapidly contracting from a stretched condition if the exercise band breaks during stretching. In some embodiments, the safety cord is 2 mm Powercord® from Fire Mountain Gems, Grants Pass, Oreg.

Elastic resistance straps such as a Thera-Band® exercise band may degrade over time and become prone to breaking during use. The safety cord disclosed here prevents an elastic resistance strap that breaks while stretched from snapping suddenly and striking a user with a section of the elastic resistance strap moving at relatively high velocity.

The band portion 105 and the cap portion 110 of the first embodiment neck therapy device 100 comprises polyester fleece. Other embodiments comprise woven and non-woven fabric, or other relatively supple material. The cap portion is sewn directly to the band portion. The cap portion is of the first embodiment neck therapy device is approximately hemispherical, and is formed from four roughly triangular panels sewn together. Cap seams 145 occur where panels meet, as shown in FIGS. 1 and 3. Other cap seams are obscured from view by the resistance strap 125. Embodiments of the neck therapy device include cap portions having concavities adapted to receive a top portion of a person's head.

As best illustrated in FIG. 2, the middle section 130 of the resistance strap 125 passes over the cap portion 110 approximately at a center top of the cap portion. In some embodiments, an additional strap loop is attached to the cap portion near the top, the resistance strap passing through the additional strap loop in order to restrain the resistance strap to a desired position atop the headpiece. In the first embodiment, the middle section 130 of the resistance strap 125 is unrestrained by an additional loop, and may therefore be adjusted to cross the cap portion in a more forward or rearward orientation in order to adjust directions of force applied to the user's head, and thus the user's neck.

Figure 4:
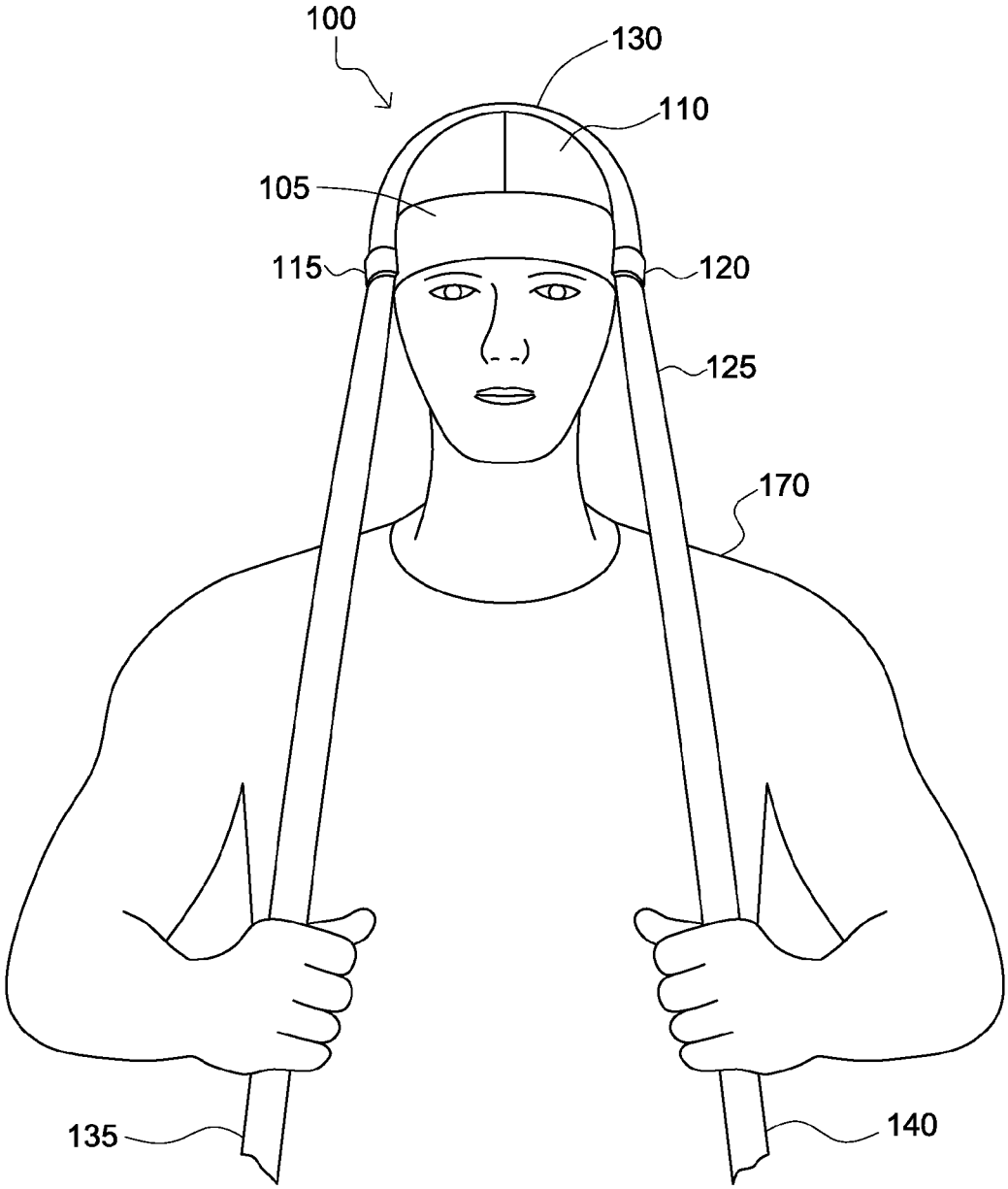
FIG. 4 is a front view of a neck therapy device according to one embodiment of the present invention.

As illustrated in FIG. 4, the middle section 130 of the resistance strap 125 resides in a top central orientation, wherein the middle section 130 passes over a top central portion of a user's head; the top central orientation is preferred for some neck exercises. For some other neck exercises, a forward orientation is preferred. In a forward orientation, the middle section 130 passes over a user's head more toward the user's forehead. For still other neck exercises, a rearward orientation is preferred. In a rearward orientation, the middle section 130 passes over a user's head more toward a back of the user's head.

The resistance strap 125 is not affixed to the band portion 105 or the cap portion 110, and is free to pass through the first strap loop 115 and the second strap loop 120. The resistance strap is therefore held in place on the headpiece by the first and second strap loops, and by friction between the resistance strap and the headpiece. The resistance strap of the first embodiment neck therapy device can be removed from the headpiece by pulling on one end of the resistance strap with the other end free to pass through the first and second strap loops, or by pulling on the middle section 130 of the resistance strap with each end of the resistance strap free to pass through one of the first or second strap loops.

As best viewed in FIGS. 2 and 3, the band portion 105 of the neck therapy device is size adjustable, meaning that the band portion can by readily adjusted to form closed loops of different sizes, and thereby fit snugly on different size heads. An adjustable end 150 of the band portion is seen in FIG. 2 in a fixed position, and in FIG. 3 in a loose position. In the loose position, a loop patch 155 and a hook patch 165 are visible. The hook patch is disposed on a fixed end 160 of the band portion. As is known to persons skilled in the art, the hook patch and loop patch are adapted to adhere to each other, and the adjustable end is therefore adapted to adhere to the fixed end in varied orientations, making the band portion, and thus the neck therapy device, adjustable to fit varied sizes of heads.

As best illustrated in FIG. 4, a user typically wears the headpiece of the first embodiment neck therapy device 100 by placing the headpiece on his or her head, with the first end section 135 and second end section 140 of the resistance strap 125 extending below the headpiece. The user grasps the resistance strap proximate it's first and second end sections in order to anchor the end sections or apply tension to the resistance strap. Anchoring the resistance strap or applying tension facilitates using the neck therapy device 100 to exercise the user's neck.

The first embodiment neck therapy device is lightweight and compact, making it readily portable. The headpiece weighs about 64 grams and the resistance strap weighs about 78 grams. Thus the total weight of the apparatus is about 142 grams. In some embodiments, the headpiece weighs preferably less than 450 grams, more preferably less than 250 grams, and most preferably less than 120 grams. Embodiments of the resistance strap weigh preferably less than 570 grams, more preferably less than 300 grams, and most preferably less than 150 grams.

A Second Embodiment Neck Therapy Device

Figure 5:
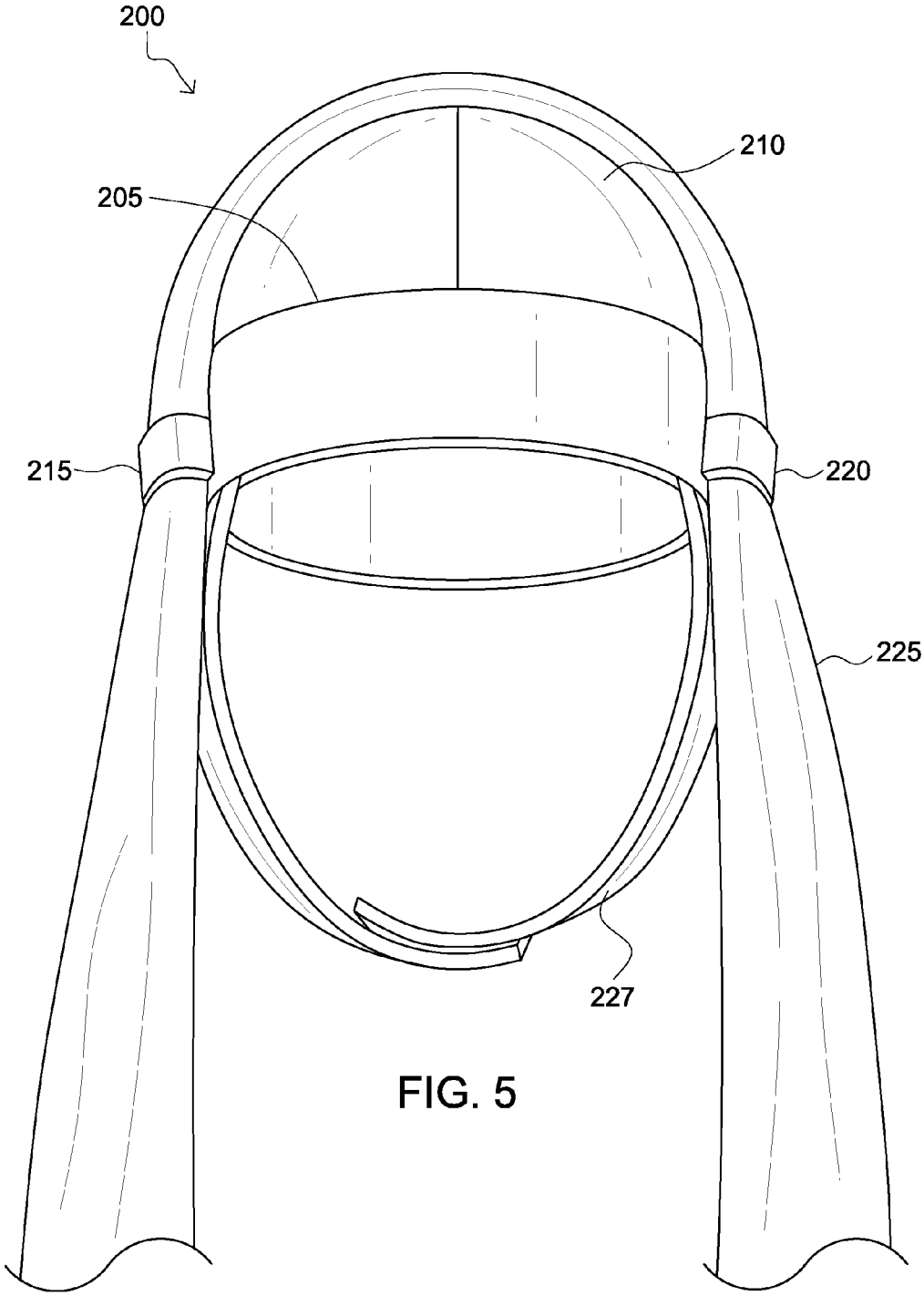
FIG. 5 is a front view of a neck therapy device according to one embodiment of the present invention.

A second embodiment neck therapy device 200 is illustrated in FIG. 5. The second embodiment neck therapy device comprises a headpiece, the headpiece including a band portion 205 and a cap portion 210. The band portion forms a closed loop adapted to encircle a user's head like a headband, extending across the user's forehead and back of head.

The neck therapy device further comprises a first strap loop 215 and a second strap loop 220, which are disposed on the band portion 205. A resistance strap 225 passes through each of the first and second strap loops.

The second embodiment neck therapy device 200 further comprises a chin strap 227. The chin strap coupled directly to the band portion at two attachment points, and is adapted to extend from one of the two attachment points, beneath a user's chin or jaw, to another of the to attachment points. The chin strap is adapted to fit snugly against the user's chin or lower jaw, and thereby help secure the neck therapy device on the user's head.

A Third Embodiment Neck Therapy Device

Figure 6A:
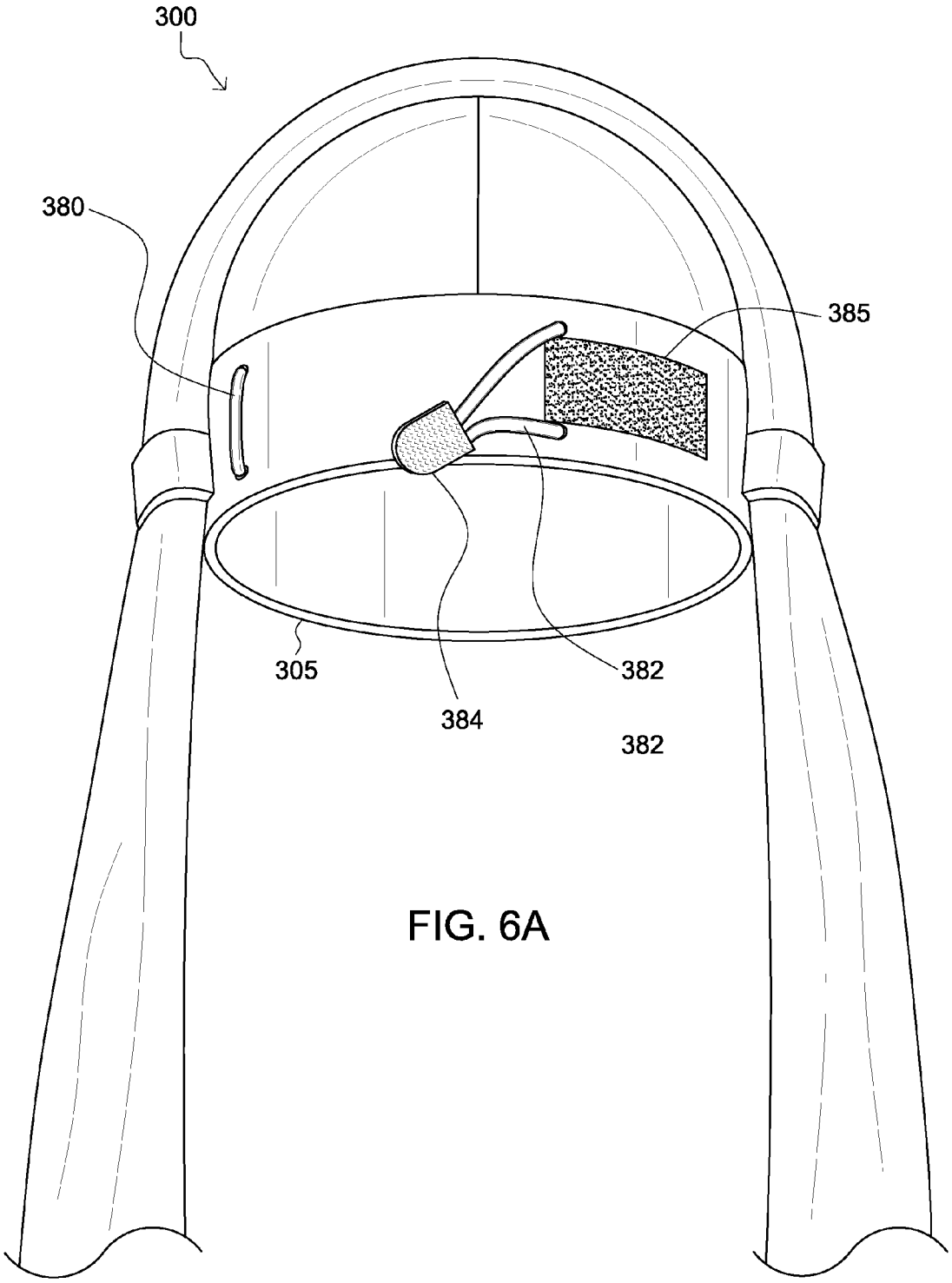
FIG. 6A is a front view of a neck therapy device according to one embodiment of the present invention.
Figure 6B:
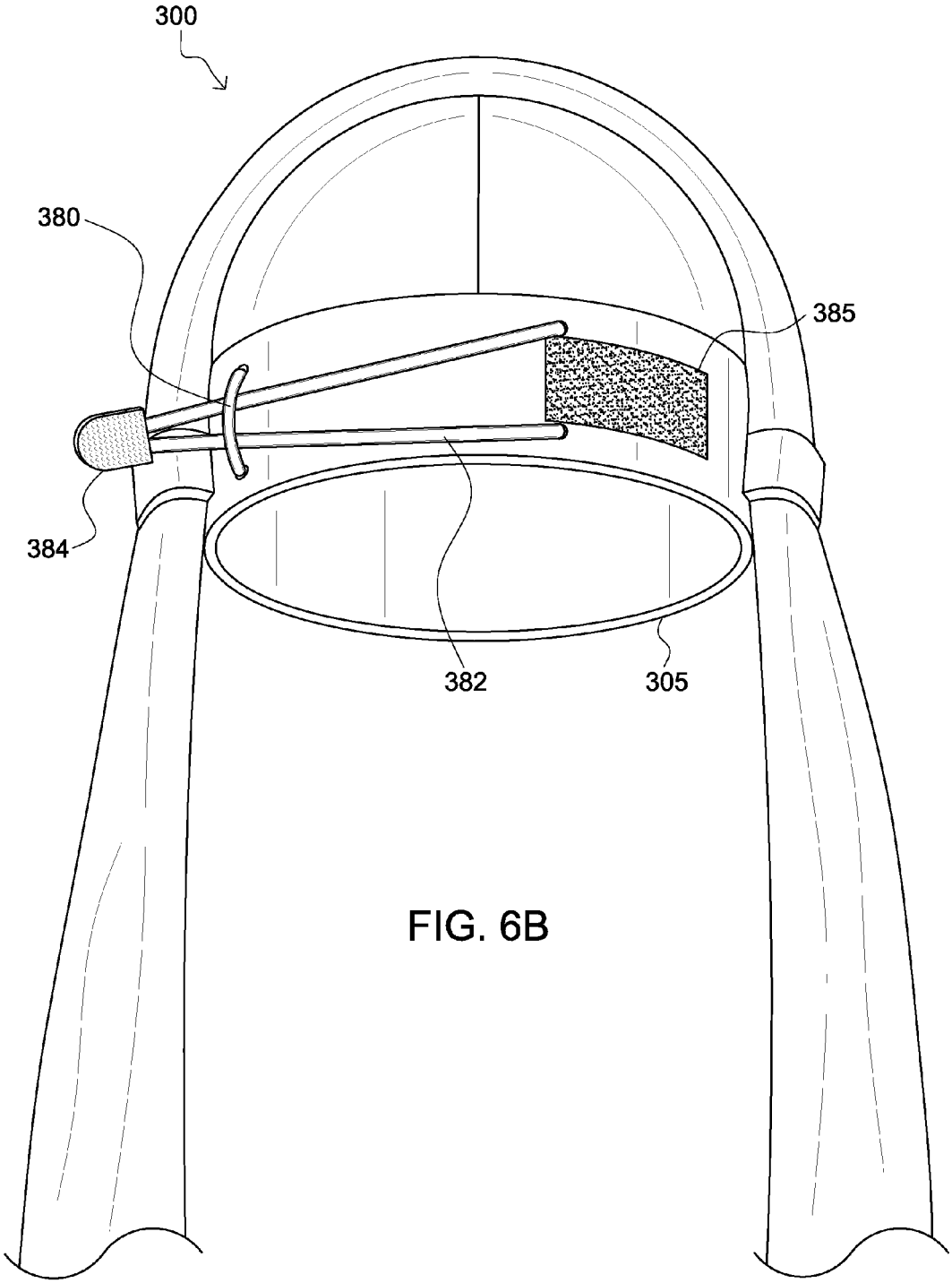
FIG. 6B is a front view of a neck therapy device according to one embodiment of the present invention.
Figure 6C:
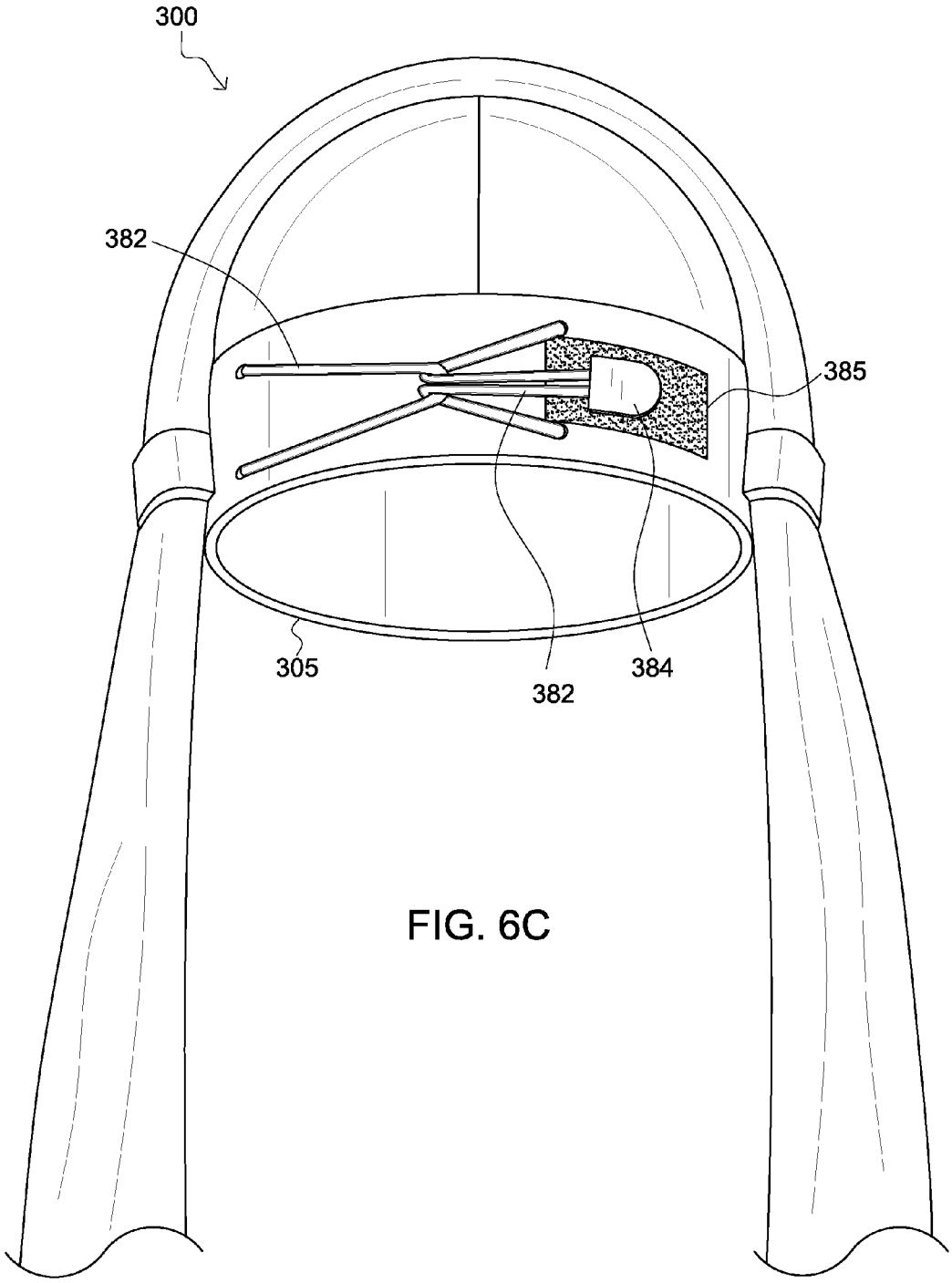
FIG. 6C is a front view of a neck therapy device according to one embodiment of the present invention.

A third embodiment neck therapy device 300 is illustrated in FIGS. 6A-6C. The third embodiment neck therapy device comprises a tensioning assembly adapted to tighten the band portion 305 around a user's head. The tensioning assembly comprises a receiving loop 380 adapted to receive a tensioning leash 382, on which a tab 384 is disposed. Tightening the band portion is achieved by passing the tensioning leash through the receiving loop and coupling the tab 384 directly to a headpiece anchor 385. The tab and headpiece anchor comprise hook and loop material that enables the tab to adhere to the anchor. The tensioning leash and receiving loop have elastic properties that facilitate tightening the band portion on a user's head. In some embodiments, a second headpiece anchor (not shown) resides proximate the receiving loop 380, or in place of the receiving loop, such that the tab can adhere to the second headpiece anchor, and thereby tighten the band portion around a user's head, without the tensioning leash 382 passing through the receiving loop.

A First Method of Using a Neck Therapy Device

Figure 7C:
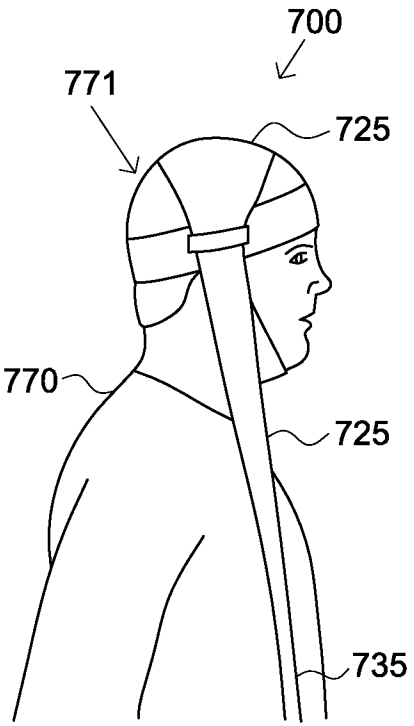
FIGS. 7A-7C illustrate a method of use of a neck therapy device according to one embodiment of the present invention.
Figure 7B:
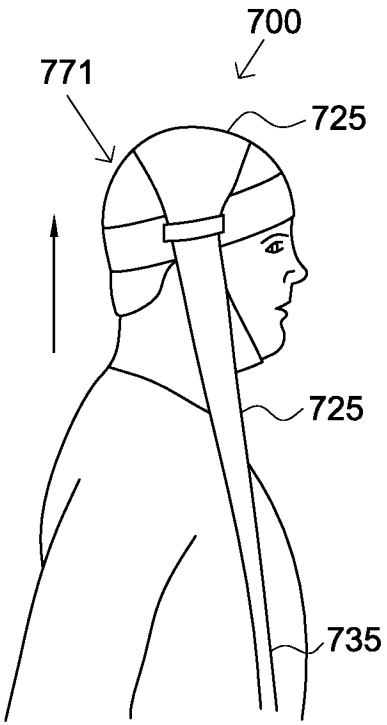
Figure 7A:
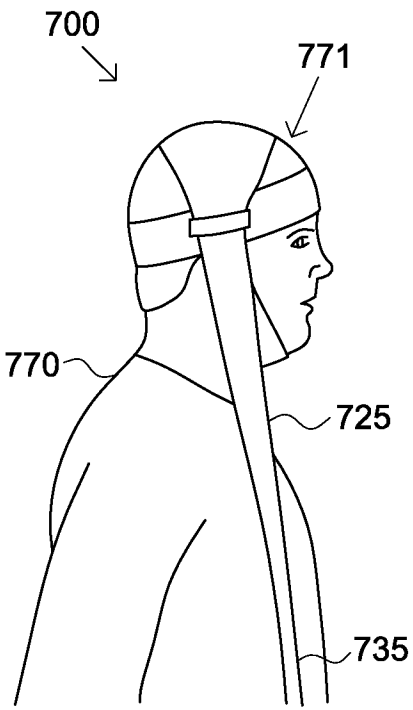

A first method of using a neck therapy device 700, the first method being referred to as a "vertical lift," is illustrated in FIGS. 7A-7C. The first method of using the neck therapy device comprises a user 770 wearing the neck therapy device with a first end section 735 and a second end section (not shown) of an elastic resistance strap 725 extending below the user's head 771. A starting position of the first method of using the neck therapy device is illustrated in FIG. 7A, wherein the user grasps the first and second end sections with his hands and holds the end sections at about hip level. As best illustrated in FIG. 7B, the first method of using the neck therapy device comprises longitudinally extending the user's neck while providing resistance to the longitudinal extension with the elastic resistance strap. The user then returns to the starting position, as illustrated in FIG. 7C, and repeats the motion illustrated in FIG. 7B.

A Second Method of Using a Neck Therapy Device

Figure 8A:
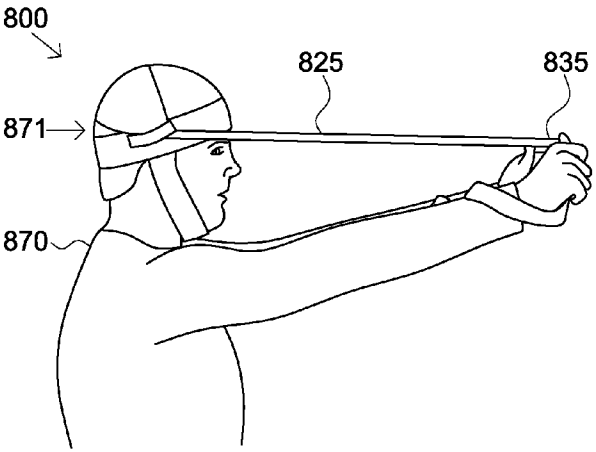
FIGS. 8A-8C illustrate a method of use of a neck therapy device according to one embodiment of the present invention.
Figure 8B:
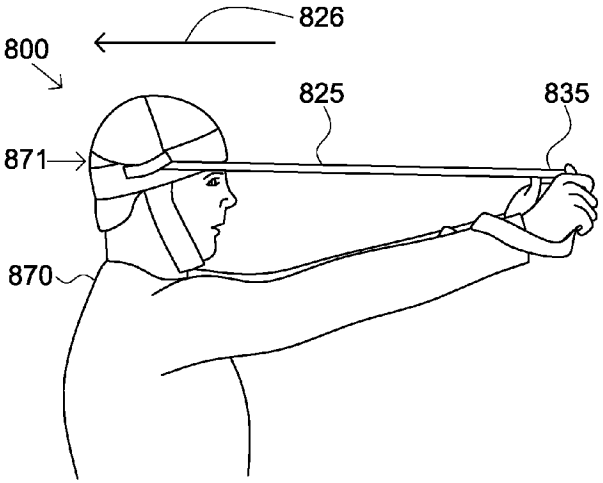
Figure 8C:
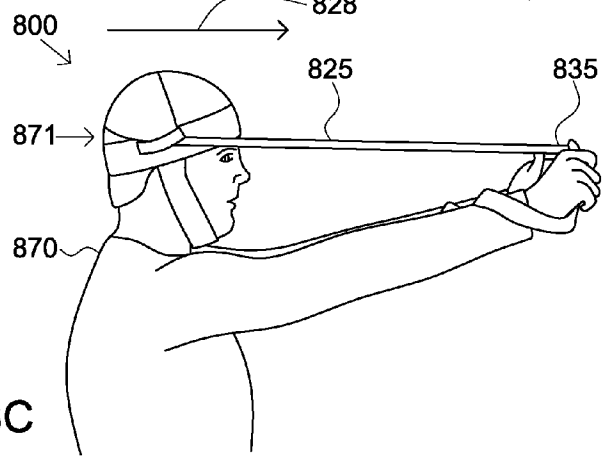

A second method of using a neck therapy device 800, the second method being referred to as a "retraction/chin tuck," is illustrated in FIGS. 8A-8C. The second method of using the neck therapy device comprises a user 870 wearing the neck therapy device with a first end section 835 and a second end section (not shown) of an elastic resistance strap 825 being held out in front of the user's head 871. A starting position of the second method of using the neck therapy device is illustrated in FIG. 8A. The user grasps the first and second end sections with his hands extends his arms in front so that the first and second end sections project out in front of the user's head, above shoulder level, with tension on the elastic resistance strap 825. The user's head is held slightly forward with the chin not tucked into the chest.

As best illustrated in FIG. 8B, the second method of using a neck therapy device comprises the user pulling his head back, as indicated by an arrow 826, while holding his head level. The elastic resistance strap 825 provides resistance to this motion, which includes tucking the chin in somewhat, without tilting the head substantially forward. As illustrated in FIG. 8C, the user then returns to the starting position by moving his head forward as indicated by an arrow 828. Motion illustrated in FIGS. 8B and 8C are then repeated.

A Third Method of Using a Neck Therapy Device

Figure 9C:
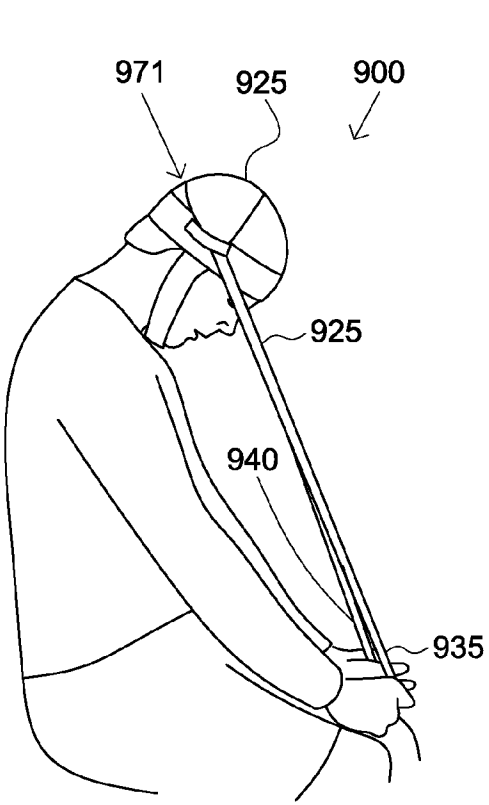
FIGS. 9A-9C illustrate a method of use of a neck therapy device according to one embodiment of the present invention.
Figure 9B:
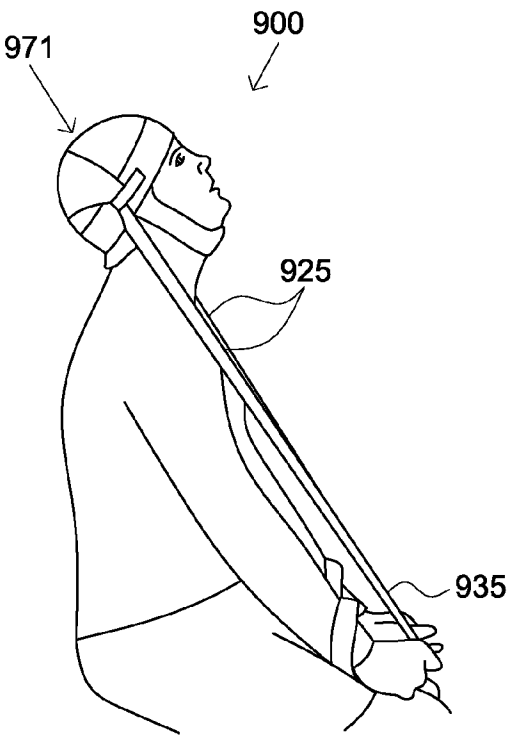
Figure 9A:
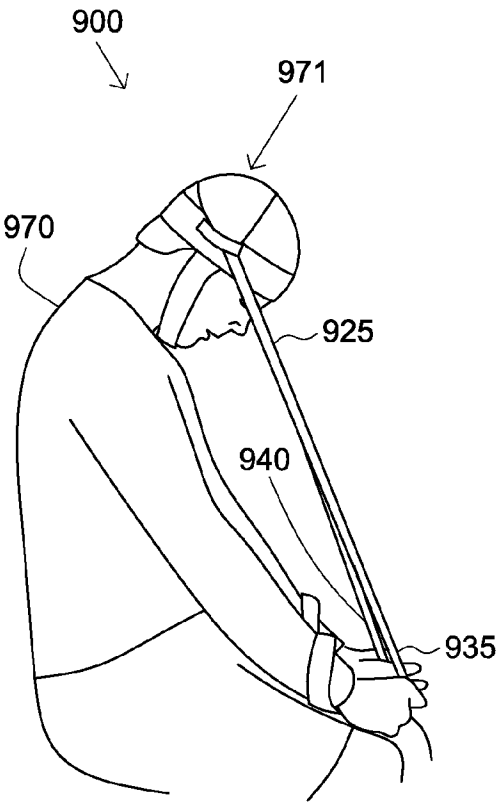

A third method of using a neck therapy device 900, the third method being referred to as an "extension," is illustrated in FIGS. 9A-9C. The user 970 is seated with his feet on the ground. A starting position of the third method of using the neck therapy device, illustrated in FIG. 9A, comprises the user 970 wearing the neck therapy device with a first end section 935 and a second end section 940 of an elastic resistance strap 925 being held proximate the user's knees. The user's head resides leaned forward with his neck flexed and his chin tucked into the chest.

As best illustrated in FIG. 9B, the third method of using the neck therapy device comprises the user 970 extending his neck while leaning his head 971 back and lifting his chin, the elastic resistance strap 925 providing resistance to this motion. The user then returns to the starting position, as illustrated in FIG. 9C, and repeats the motion illustrated in FIG. 9B.

A Fourth Method of Using a Neck Therapy Device

Figure 10B:
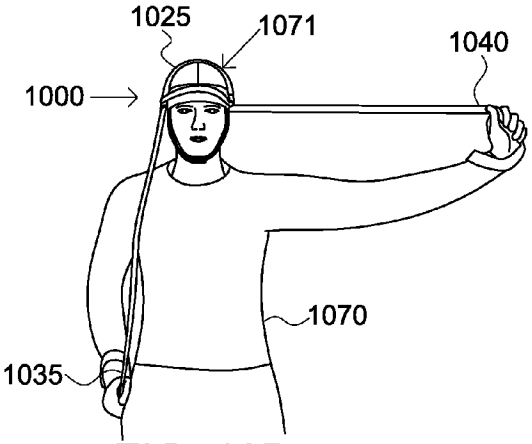
FIGS. 10A-10D illustrate a method of use of a neck therapy device according to one embodiment of the present invention.
Figure 10A:
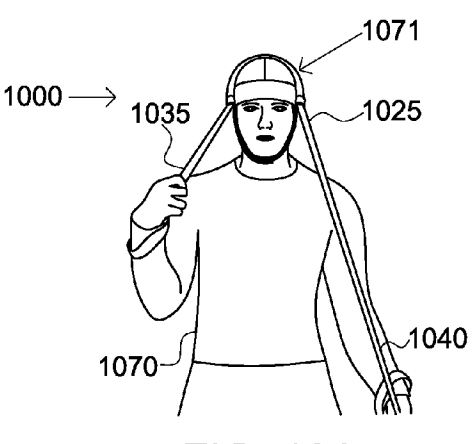

A fourth method of using a neck therapy device 1000, the fourth method being referred to as a "rotation," is illustrated in FIGS. 10A-10D. As illustrated in FIG. 10A, the user 1070 is wearing the neck therapy device with a first end section 1035 held proximate the user's right shoulder and a second end section 1040 of an elastic resistance strap 1025 being held proximate the user's left hip. The user's head 1071 resides in a neutral position, the neutral position being, as illustrated in FIG. 10A, where the user is facing straight ahead with his head level, neither tilted or leaning, and his neck straight, neither flexed, extended, longitudinally extended, rotated, or leaning.

As best illustrated in FIG. 10B, the user achieves a starting position by wrapping the elastic resistance strap 1025 around his head 1071, the resistance strap extending first across the user's forehead and then around the back of his head, with the second end portion 1040 of the resistance strap then extending to the user's left hand at the end of the user's outstretched left arm. The user's outstretched left arm projects outwardly to the user's left side at approximately shoulder level, and the elastic resistance strap is stretched. The first end portion 1035 of the elastic resistance strap is held proximate the user's left hip, also stretched.

Figure 10D:
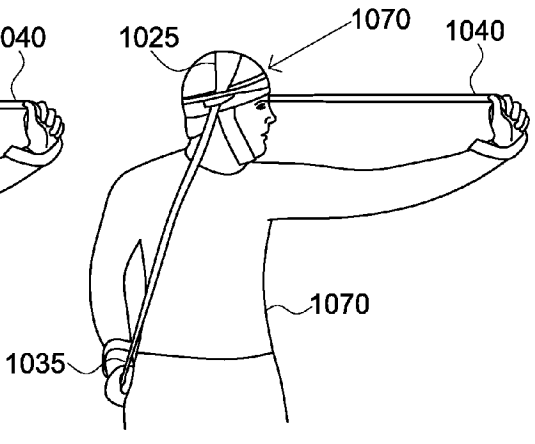
Figure 10C:
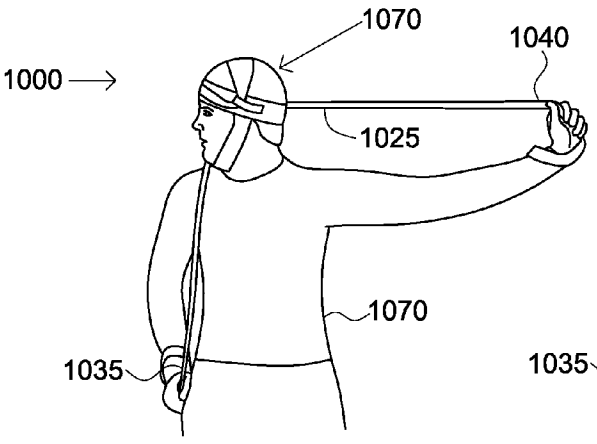

As best illustrated in FIG. 10C, the fourth method of using the neck therapy device 1000 comprises the user rotating his head 1071 to the right until the user's chin is approximately over the user's right shoulder. Tension applied through the second end portion 1040 assists this motion, while tension applied through the first end portion 1035 pulls downwardly on the user's head As best illustrated in FIG. 10D, the fourth method of using the neck therapy device 1000 further comprises the user rotating his head to the left until the user's chin is approximately over the user's right shoulder. Tension applied through the second end portion 1040 resists this motion, while tension applied through the first end portion 1035 pulls downwardly on the user's head. The left and right rotation of the user's head is then repeated.

Another method of using the neck therapy device is analogous to the fourth method and includes the same motions, except with the first and second end sections of the elastic resistance strap exchanging roles, so that the first end section is held at the end of the user's right arm extended outwardly to the right, and the second end section being held proximate the user's left hip. Accordingly, the resistance strip assists the users turning his head to the left and resists the user turning his head to the right.

A Fifth Method of Using a Neck Therapy Device

Figure 11B:
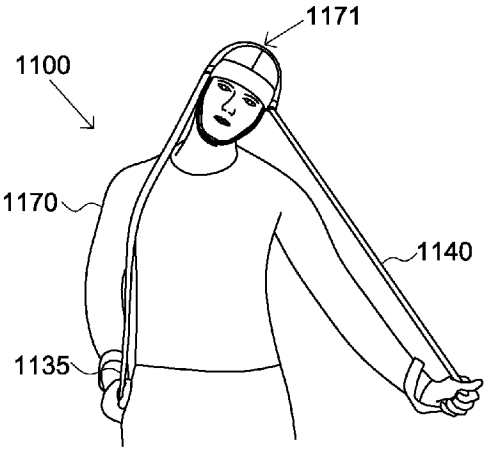
FIGS. 11A-11C illustrate a method of use of a neck therapy device according to one embodiment of the present invention.
Figure 11A:
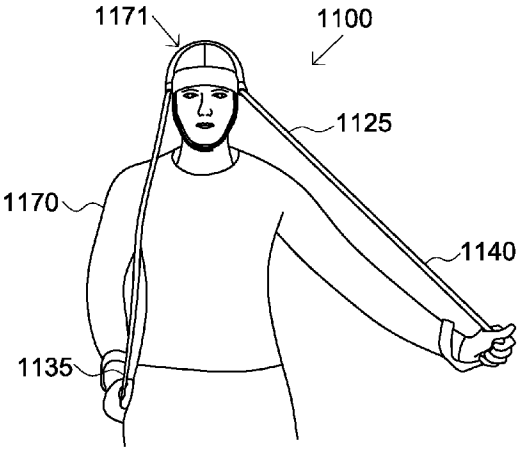
Figure 11C:
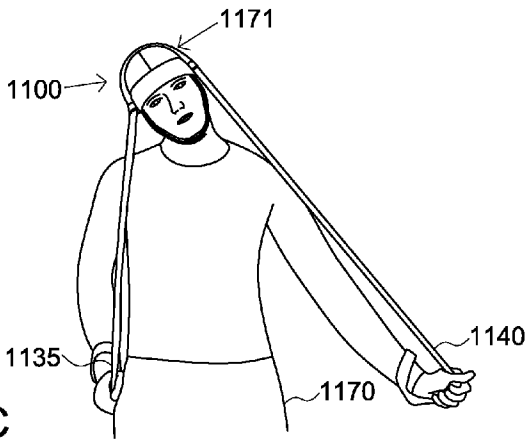

A fifth method of using a neck therapy device 1100, referred to as a "side bend," is illustrated in FIGS. 11A-11C. A starting position of the fifth method of using the neck therapy device, illustrated in FIG. 11A, comprises the user 1170 wearing the neck therapy device with a first end section 1135 of an elastic resistance 1125 strap being held in the user's right hand proximate the user's right hip. A second end section 1140 of the elastic resistance strap 1125 is held in the user's left hand with his left arm extended downwardly at an angle about 45° to vertical. The user's head resides in a neutral position with the user facing straight ahead. The elastic resistance strap is stretched.

As best illustrated in FIG. 11B, the fifth method of using the neck therapy device comprises the user tilting his head 1171 to the left. Subsequently, the fifth method comprises the user tilting his head to the right and the elastic resistance strap 1125. The user then returns to the starting position, as illustrated in FIG. 11A, and repeats the motion illustrated in FIGS. 11B and 11C.

A Sixth Method of Using a Neck Therapy Device

A sixth method of using a neck therapy device 1200, the sixth method being referred to as "flexion," is illustrated in FIGS. 12A-12C. A starting position of the sixth method of using the neck therapy device, illustrated in FIGS. 12A and 12B, comprises the user 1270 wearing the neck therapy device with a first end section 1235 and second end section of an elastic resistance strap 1225 extending behind the user's left and right shoulders, respectively. The first and second end sections are held in the user's hands proximate the user's waist, with the user's arms bent at about 105°. The user's head 1271 resides in a neutral position with the user facing straight ahead. The elastic resistance strap is stretched. The user begins with longitudinal extension of his neck, lifting the top of his head up.

As best illustrated in FIG. 12C, the sixth method of using the neck therapy device comprises the user leaning his head 1271 forward while tucking his chin into his chest and flexing his neck. The elastic resistance strap resists this neck flexing motion. Subsequently, the sixth method comprises the user lifting his chin and extending his neck to return his head to a neutral position illustrated in FIG. 12B, and repeats the motion illustrated in FIG. 12C.

A Seventh Method of Using a Neck Therapy Device

Figure 13C:
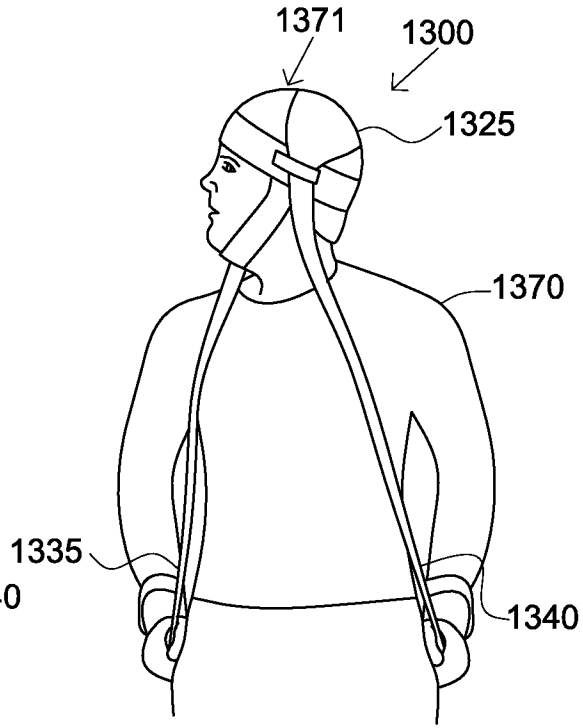
FIGS. 13A-13C illustrate a method of use of a neck therapy device according to one embodiment of the present invention.
Figure 13B:
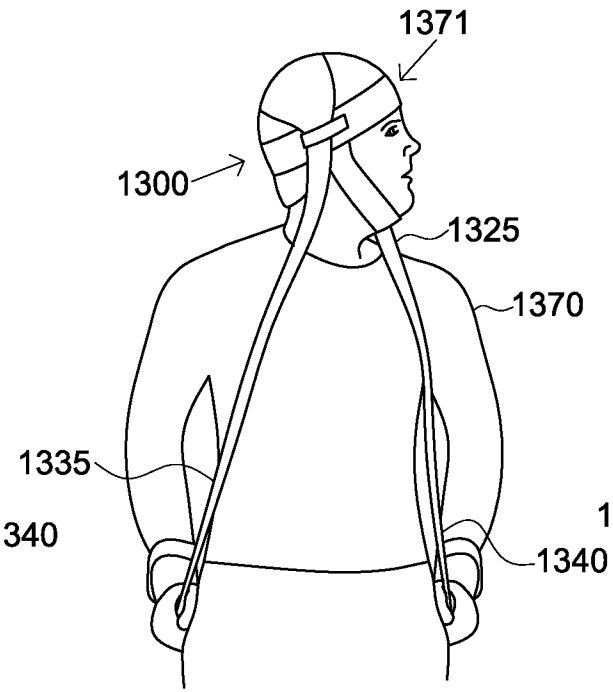
Figure 13A:
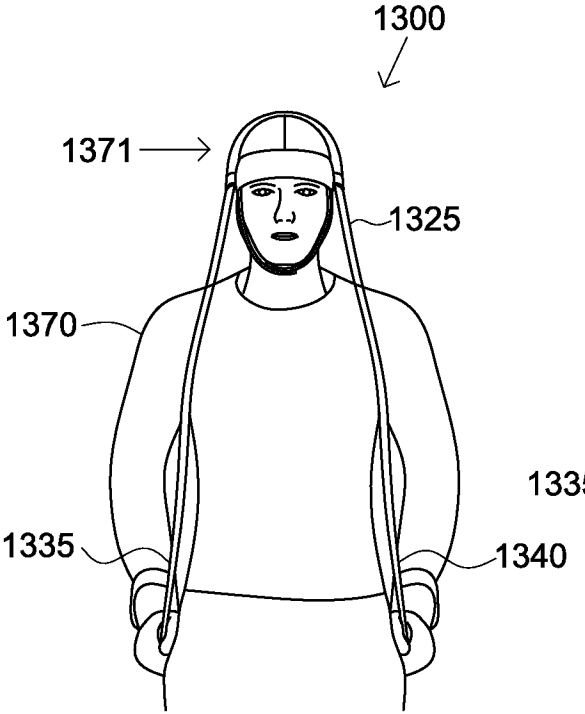

A seventh method of using a neck therapy device 1300, referred to as a "lift and rotate," is illustrated in FIGS. 13A-13C. A starting position of the seventh method of using the neck therapy device, illustrated in FIG. 13A, comprises the user 1370 wearing the neck therapy device with a first end section 1335 and a second end section 1340 of an elastic resistance 1325 strap extending downwardly below the user's head and being held in the user's left and right hand, respectively. The user's left and right hands reside at the user's sides proximate the left and right hips. The user's head resides in a neutral position with the user facing straight ahead. The elastic resistance strap is stretched.

As best illustrated in FIG. 13B, the seventh method of using the neck therapy device comprises the user rotating his head 1371 to the left while looking up and over his left shoulder. The elastic resistance strap resists this motion. Subsequently, the seventh method comprises the user slowly returning his head to a neutral position, followed by the user rotating his head 1371 to the right while looking up and over his right shoulder. The elastic strap resists this motion also. The user then repeats the motion illustrated in FIGS. 13B and 13C, slowly returning his head to a neutral position between rotations.

A Fourth Embodiment Neck Therapy Device

Figure 14A:
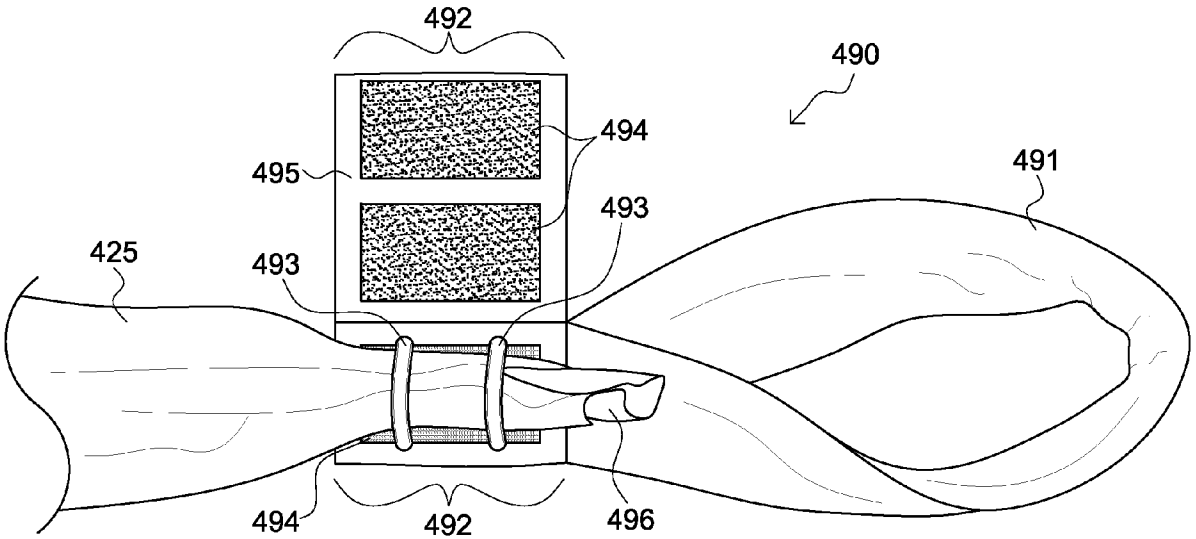
FIG. 14A is a plan view of a neck therapy device according to one embodiment of the present invention.
Figure 14B:
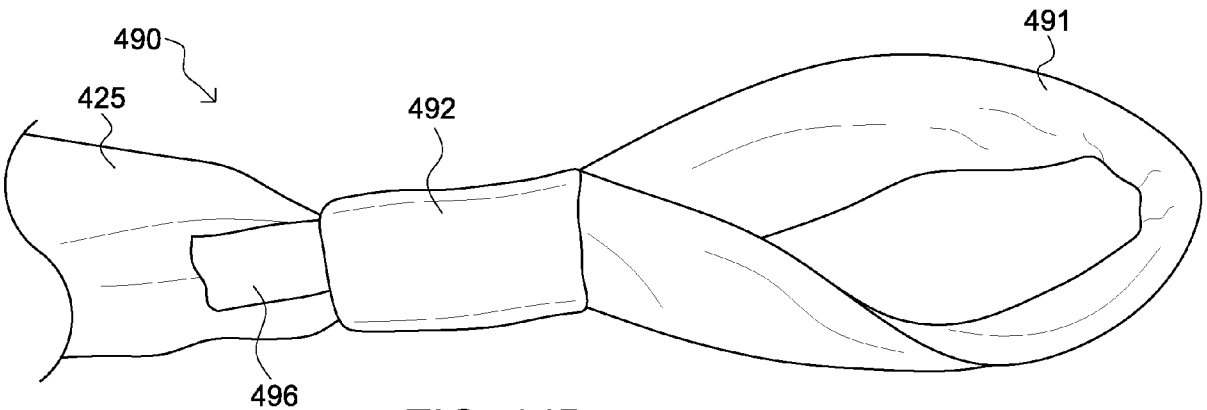
FIG. 14B is a plan view of a neck therapy device according to one embodiment of the present invention.

A fourth embodiment neck therapy device is illustrated in FIGS. 14A and 14B. The fourth embodiment neck therapy device comprises a security hold 490 adapted to couple to a resistance strap 425. The security hold comprises a loop portion 491 and strap fixing portion 492, the strap fixing portion being adapted to couple the resistance strap to the security hold. The strap fixing portion comprises two fixing loops 493, through which the resistance strap passes in order to secure the security hold to the resistance strap. The strap fixing portion further comprises contact patches 494 and a binding strap 495, two of the contact patches being disposed on the binding strap. The contact patches comprise Velcro® or other hook and loop structures known to persons skilled in the art.

An effective means of securing the security hold 490 to the resistance strap 425 includes passing an end of the resistance strap through the two fixing loops 493, and folding a short section 496 of the resistance strap back upon itself such that the short section resides outside the fixing loops. The binding strap 495 then wraps around the strap fixing portion 492, with the contact patches 494 adhering to each other and the resistance strap thus being held securely within the strap fixing portion, as best illustrated in FIG. 14B.

In typical use, a user places a headpiece of a neck therapy device on his or her head, and then passes his or her hands through loop portions of security holds after affixing a security hold to each end of an elastic resistance strap. The user then grasps the resistance strap proximate each end and performs a neck exercise. The security hold provides an element of safety such that if the resistance strap, while stretched, slips from within the grasp of the user, the security hold will help prevent an end of the resistance strap from rapidly accelerating. Thus the resistance strap may be prevented from striking the user at relatively high velocity. In addition, should the security hold slip off the user's hands or arms, it presents little hazard to the user because the security hold typically comprises supple, low density material such as polyester fleece. Consequently, the security hold has a soft surface and relatively low mass, and is unlikely to injure the user even if it strikes the user in the face.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, in some embodiments a neck therapy device comprises strap loops coupled to or disposed on a helmet or other headgear. Variations include strap loops detachably coupled to a helmet or other headgear by use of hook and loop fastening means. Helmet's include, but are not limited to, football helmets and aviator helmets. A resistance strap typically extends through the strap loops in order to facilitate neck exercises or other therapy.

I claim:

1. A neck therapy device comprising:

a headpiece, the headpiece including a band portion and a cap portion coupled to the band portion, the cap portion including an outer surface and the band portion including a closed loop having a circumference of more than 15 inches;

a first strap loop and a second strap loop, each of the first and second strap loops being coupled directly to the headpiece and including a strap loop aperture; and an elastic resistance strap (i) extending through the strap loop apertures, (ii) extending along the cap portion outer surface between the first strap loop and the second strap loop, and (iii) including two free ends available to be grasped by a user.

2. The neck therapy device of claim 1, wherein the band portion is size adjustable.

3. The neck therapy device of claim 1, wherein the band portion comprises substantially supple material.

4. A method of using of using a neck therapy device comprising:

providing the neck therapy device of claim 1;

wearing the neck therapy device; and applying tension to the resistance strap.

5. A method of using of using a neck therapy device comprising:

providing the neck therapy device of claim 1;

wearing the neck therapy device;

stretching the elastic resistance strap; and performing a neck exercise.

6. The method of claim 5, wherein the strap loops reside on opposite sides of a user's head.

7. A neck therapy device comprising:

a headpiece, the headpiece including a band portion and a cap portion, the band portion being coupled to the cap portion and comprising supple material forming a closed loop, the closed loop having a circumference of more than 15 inches, and the cap portion including a concavity and an outer surface;

a first strap loop and a second strap loop, the first strap loop including a first strap loop aperture and the second strap loop including a second strap loop aperture; and a first resistance strap, the first resistance strap (i) being elastic, (ii) having first elasticity parameters, (iii) extending through the first strap loop aperture and the second strap loop aperture, (iv) extending along the cap portion outer surface between the first strap loop and the second strap loop, and (v) including two free ends available to be grasped by a user.

8. The neck therapy device of claim 7, wherein the first resistance strap is not coupled directly to both the first strap loop and the second strap loop.

9. The neck therapy device of claim 7, wherein the first resistance strap is not coupled directly to either or both of the first strap loop and the second strap loop.

10. A method of using the neck therapy device of claim 7 comprising:

placing the headpiece on a user's head;

applying tension to the resistance strap.

11. The method of claim 10, further comprising performing a neck exercise.

12. The method of claim 11, wherein the first strap loop and the second strap loop reside on opposite sides of the user's head.

13. The method of claim 12, further comprising replacing the first resistance strap with a second resistance strap, the second resistance strap having second elasticity parameters that differ from the first resistance strap.

* * * * *